US009119003B2

(12) United States Patent
Fukuoka et al.

(10) Patent No.: US 9,119,003 B2
(45) Date of Patent: Aug. 25, 2015

(54) SOUND GENERATOR AND SOUND-GENERATING APPARATUS

(75) Inventors: Shuichi Fukuoka, Kirishima (JP); Noriyuki Kushima, Kirishima (JP); Hiroshi Ninomiya, Kirishima (JP); Takeshi Hirayama, Kirishima (JP); Kenji Yamakawa, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/111,884

(22) PCT Filed: Jun. 29, 2012

(86) PCT No.: PCT/JP2012/066754
§ 371 (c)(1),
(2), (4) Date: Oct. 22, 2013

(87) PCT Pub. No.: WO2013/002384
PCT Pub. Date: Jan. 3, 2013

(65) Prior Publication Data

US 2014/0098978 A1 Apr. 10, 2014

(30) Foreign Application Priority Data

Jun. 29, 2011 (JP) ..... 2011-144435

(51) Int. Cl.
*H04R 25/00* (2006.01)
*H04R 17/00* (2006.01)
*H04R 1/26* (2006.01)
*H04R 17/02* (2006.01)

(52) U.S. Cl.
CPC ..... *H04R 17/00* (2013.01); *H04R 1/26* (2013.01); *H04R 17/02* (2013.01); *H04R 2201/401* (2013.01)

(58) Field of Classification Search
USPC ..... 381/190, 173
See application file for complete search history.

(56) References Cited

U.S. PATENT DOCUMENTS

| | | | | |
|---|---|---|---|---|
| 5,031,222 | A | 7/1991 | Takaya | |
| 6,278,790 | B1 * | 8/2001 | Davis et al. | 381/398 |
| 2008/0218031 | A1 * | 9/2008 | Kuroda et al. | 310/334 |

FOREIGN PATENT DOCUMENTS

| | | | |
|---|---|---|---|
| CN | 2071409 | U | 2/1991 |
| JP | S54-109825 | A | 8/1979 |

(Continued)

OTHER PUBLICATIONS

Chinese Office Action with English concise explanation, Chinese Patent Application No. 201280013261.6, Jun. 3, 2015, 7 pgs.

*Primary Examiner* — Davetta W Goins
*Assistant Examiner* — Amir Etesam
(74) *Attorney, Agent, or Firm* — Volpe and Koenig, P.C.

(57) ABSTRACT

There are provided a sound generator with less peaks and dips in sound-pressure frequency characteristics, and a sound-generating apparatus which employs the sound generator. A sound generator and a sound-generating apparatus using the same are provided, wherein the sound generator includes at least a vibration plate, and a plurality of piezoelectric elements attached to the vibration plate so as to be spaced from each other to cause the vibration plate to vibrate. The plurality of piezoelectric elements includes piezoelectric elements having at least two different thicknesses. The piezoelectric elements having at least two different thicknesses are disposed in two directions that cross each other in a main surface of the vibration plate. Accordingly, it is possible to achieve a sound generator, as well as a sound-generating apparatus which have less peaks and dips in sound-pressure frequency characteristics.

10 Claims, 9 Drawing Sheets

(56) References Cited

FOREIGN PATENT DOCUMENTS

| | | | |
|---|---|---|---|
| JP | S57-176799 | U | 11/1982 |
| JP | H03-216099 | A | 9/1991 |
| JP | 2003-134593 | A | 5/2003 |
| JP | 2004-023436 | A | 1/2004 |
| WO | 9935883 | A1 | 7/1999 |
| WO | 2007/060768 | A1 | 5/2007 |

* cited by examiner

SOUND GENERATOR AND SOUND-GENERATING APPARATUS

TECHNICAL FIELD

The present invention relates to a sound generator and a sound-generating apparatus employing the sound generator.

BACKGROUND ART

There is a heretofore known sound generator constructed by attaching a piezoelectric element to a vibration plate (refer to Patent Literature 1, for example).

CITATION LIST

Patent Literature

Patent Literature 1: Japanese Unexamined Patent Publication JP-A 2004-23436

SUMMARY OF INVENTION

Technical Problem

However, in the aforementioned conventional sound generator, a resonance phenomenon occurs at a specific frequency, which gives rise to the problem of susceptibility to acute peaks and dips in sound-pressure frequency characteristics.

The invention has been devised in view of the problem associated with the conventional art as mentioned supra, and accordingly an object of the invention is to provide a sound generator with less peaks and dips in sound-pressure frequency characteristics, and a sound-generating apparatus which employs the sound generator.

Solution to Problem

The invention provides a sound generator comprising at least: a vibration plate; and a plurality of piezoelectric elements attached to the vibration plate so as to be spaced from each other to cause the vibration plate to vibrate, the plurality of piezoelectric elements including piezoelectric elements having at least two different thicknesses, the plurality of piezoelectric elements having at least two different thicknesses being disposed in two directions that cross each other in a main surface of the vibration plate.

The invention provides a sound-generating apparatus comprising at least: at least one high-pitched sound speaker; at least one low-pitched sound speaker; and a support body which supports the high-pitched sound speaker and the low-pitched sound speaker, at least one of the high-pitched sound speaker and the low-pitched sound speaker being constructed of the sound generator.

Advantageous Effects of Invention

According to the sound generator and the sound-generating apparatus of the invention, it is possible to minimize peaks and dips in sound-pressure frequency characteristics.

DESCRIPTION OF EMBODIMENTS

Hereinafter, a sound generator pursuant to the invention will be described in detail with reference to the accompanying drawings. Note that the sound generator is a device having the function of converting electric signals into acoustic signals, and, the term "sound" is construed as encompassing, not only vibration in an audible frequency range, but also, for example, vibration of frequencies beyond the range of audible frequencies such as ultrasound.

First Embodiment

Figure 1:
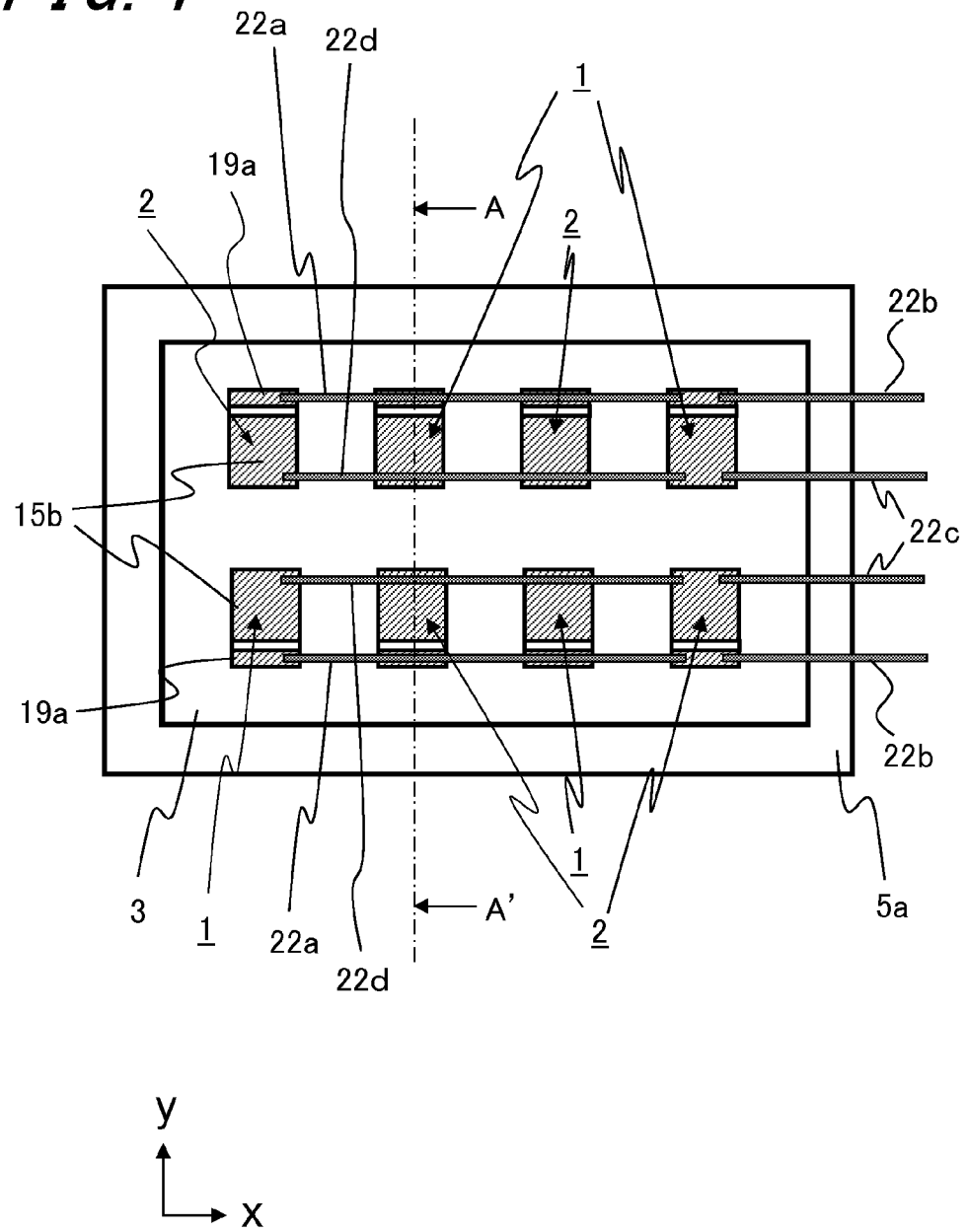
FIG. 1 is a plan view schematically showing a sound generator in accordance with a first embodiment of the invention.
Figure 2:
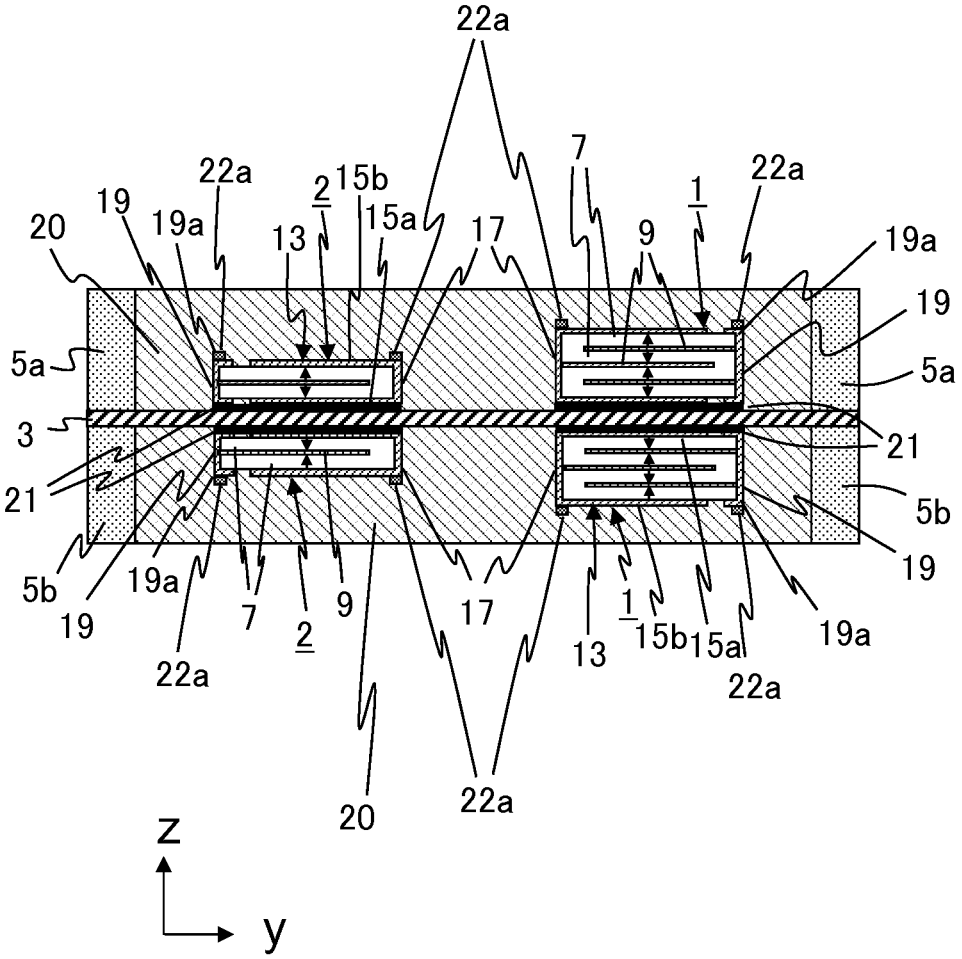
FIG. 2 is a sectional view taken along the line A-A' shown in FIG. 1.

FIG. 1 is a plan view schematically showing a sound generator in accordance with a first embodiment of the invention. FIG. 2 is a sectional view taken along the line A-A' shown in FIG. 1. For a better understanding of the structure, in FIG. 1, the diagrammatic illustration of a resin layer 20 is omitted, and, in FIG. 2, there is shown the sound generator enlarged in the direction of its thickness (the direction of z-axis in the drawing).

As shown in FIGS. 1 and 2, the sound generator of this embodiment comprises: a plurality of piezoelectric elements 1; a plurality of piezoelectric elements 2; a film 3; frame members 5*a* and 5*b*; a resin layer 20; and conductor wires 22*a*, 22*b*, 22*c*, and 22*d*.

The film 3 is, at its periphery, fixedly sandwiched between the frame members 5*a* and 5*b* under tension, and is supported by the frame members 5*a* and 5*b* so as to be able to vibrate and serves as a vibration plate.

In response to application of an electric signal, the piezoelectric elements 1 and 2 undergo stretching vibration in a direction parallel to the main surface of the film 3. Moreover, the plurality of piezoelectric elements 1 are disposed in pairs, and, two piezoelectric elements 1 taken as a pair are placed on both sides, respectively, of the film 3 so as to hold the film 3 between them. Moreover, the paired two piezoelectric elements 1 are so disposed that their stretching-vibration directions substantially coincide with each other. In the paired piezoelectric elements 1, when one of them contracts, the other expands. Similarly, the plurality of piezoelectric elements 2 are disposed in pairs, and, two piezoelectric elements 2 taken as a pair are placed on both sides, respectively, of the film 3 so as to hold the film 3 between them. Moreover, the paired two piezoelectric elements 2 are so disposed that their stretching-vibration directions substantially coincide with each other. In the paired piezoelectric elements 2, when one of them contracts, the other expands.

Moreover, four piezoelectric elements 1 are attached to each side of the film 3, or equivalently the film 3 has a total of eight piezoelectric elements 1 in all, and similarly, four piezoelectric elements 2 are attached to each side of the film 3, or equivalently the film 3 has a total of eight piezoelectric elements 2 in all. That is, the number of the piezoelectric elements 1 attached to the film 3 and the number of the piezoelectric elements 2 attached thereto are equal. The plurality of piezoelectric elements 1 and 2 are spaced apart on each side of the film 3.

Moreover, the piezoelectric element 1 and the piezoelectric element 2 differ from each other in thickness, and, vibrators having different thicknesses (piezoelectric element 1 and piezoelectric element 2) are disposed in sequence in two directions that cross each other in the main surface of the film 3 (two directions that are perpendicular to each other, namely x-axis direction and y-axis direction as indicated in the drawing). That is, the piezoelectric elements 1 and the piezoelectric elements 2 are disposed to be alternating with each other in each of the x-axis direction and the y-axis direction in the drawing, namely respective two directions that cross each other in the main surface of the film 3 (two directions that are perpendicular to each other).

In one of the two directions that cross each other in the main surface of the film 3 (the x-axis direction in the drawing), intervals between the piezoelectric elements 1 are equal, intervals between the piezoelectric elements 2 are equal, and intervals between adjacent piezoelectric element 1 and piezoelectric element 2 are equal. Also, in the other of the two directions that cross each other in the main surface of the film 3 (the y-axis direction in the drawing), the piezoelectric elements 1 and their neighboring piezoelectric elements 2 are disposed at equally-spaced intervals.

The piezoelectric element 1, 2 is composed of: a stacked body 13 in which ceramic-made piezoelectric layers 7 and internal electrode layers 9 are alternately laminated; surface electrode layers 15*a* and 15*b* formed on the upper and lower surfaces, respectively, of the stacked body 13; and a pair of external electrodes 17 and 19 that are formed at opposed ends, respectively, of the stacked body 13 in a longitudinal direction (the y-axis direction in the drawing). Note that the piezoelectric element 1 includes four piezoelectric layers 7 and three internal electrode layers 9, whereas the piezoelectric element 2 includes two piezoelectric layers 7 and one internal electrode layer 9. Hence, the piezoelectric element 1 is about twice as thick as the piezoelectric element 2.

In the piezoelectric element 1, the external electrode 17 is connected to the surface electrode layers 15*a* and 15*b* and one internal electrode layer 9, and the external electrode 19 is connected to two internal electrode layers 9. In the piezoelectric element 2, the external electrode 17 is connected to the surface electrode layers 15*a* and 15*b*, and the external electrode 19 is connected to one internal electrode layer 9. The piezoelectric layers 7 are polarized in the thickness-wise direction in an alternating manner as indicated by arrows in FIG. 2, and are so designed that, when the piezoelectric layer 7 of the piezoelectric element 1, 2 placed on the upper surface of the film 3 contracts, then the piezoelectric layer 7 of the piezoelectric element 1, 2 placed on the lower surface of the film 3 expands, thereby permitting application of voltage to the external electrodes 17 and 19.

The upper and lower ends of the external electrode 19 are extended to the upper and lower surfaces, respectively, of the stacked body 13 to form extensions 19*a*, and, to avoid contact with the surface electrode layer 15*a*, 15*b* formed on the surface of the stacked body 13, the extension 19*a* is spaced a predetermined distance away from the surface electrode layer 15*a*, 15*b*.

On that surface of the stacked body 13 opposite from the film 3-sided surface, the extensions 19*a* of, respectively, the piezoelectric elements 1 and 2 disposed adjacent to each other in the lengthwise direction of the sound generator (the x-axis direction in the drawing) are connected to each other by the conductor wire 22*a*, and, the extension 19*a* of the vibrator located at one end of the sound generator is connected with one end of the conductor wire 22*b*, and the other end of the conductor wire 22*b* is drawn to the outside. Moreover, the surface electrode layers 15*b* connected to the external electrodes 17 of, respectively, the vibrators disposed adjacent to each other in the lengthwise direction of the sound generator (the x-axis direction in the drawing) are connected to each other by the conductor wire 22*d*, and, the surface electrode layer 15*b* of the vibrator located at one end of the sound generator is connected with one end of the conductor wire 22*c*, and the other end of the conductor wire 22*c* is drawn to the outside.

Accordingly, the plurality of piezoelectric elements 1 and 2 disposed in the lengthwise direction of the sound generator (the x-axis direction in the drawing) are connected in parallel with each other, and are subjected to the same voltage through the conductor wires 22*b* and 22*c*.

The piezoelectric element 1, 2 is shaped like a plate, in which the upper and lower main surfaces are shaped in a rectangle, and the opposed side surfaces in the longitudinal direction of the main surface of the stacked body 13 (the y-axis direction in the drawing) are paired side surfaces to which the internal electrode layers 9 are alternately led out.

The piezoelectric element 1, 2 is, at its film 3-sided main surface, bonded to the film 3 by an adhesive layer 21. The thickness of the adhesive layer 21 interposed between the piezoelectric element 1, 2 and the film 3 is adjusted to be less than or equal to 20 μm. It is particularly desirable to adjust the thickness of the adhesive layer 21 to be less than or equal to 10 μm. Where the thickness of the adhesive layer 21 is less than or equal to 20 μm, vibration of the stacked body 13 can be readily transmitted to the film 3.

A heretofore known adhesive such as epoxy resin, silicon resin, or polyester resin can be used to form the adhesive layer 21.

In the piezoelectric characteristics of the piezoelectric element 1, 2, it is preferable that the piezoelectric constant d31 is higher than or equal to 180 pm/V in the interest of induction of great flexural (bending) vibration for a rise in sound pressure. So long as the piezoelectric constant d31 is higher than or equal to 180 pm/V, the average of sound pressures in the range of 60 to 130 KHz can stand at a level of greater than or equal to 65 dB.

In the sound generator of this embodiment, a resin is charged inside the frame members 5*a* and 5*b* to form the resin layer 20, in which are embedded the piezoelectric elements 1 and 2. Part of the conductor wires 22*a* and 22*b* is also embedded in the resin layer 20. Materials that can be used for the resin layer 20 include, for example, acrylic resin, silicon resin, and rubber, and more specifically those having a Young's modulus in a range of 1 MPa to 1 GPa are desirable, or those having a Young's modulus in a range of 1 MPa to 850 MPa are particularly desirable. Moreover, it is desirable to apply the resin layer 20 in a thickness large enough to cover the piezoelectric elements 1 and 2 completely from the viewpoint of suppressing spurious components. Furthermore, the film 3 which serves as a vibration plate vibrates unitarily with the piezoelectric elements 1 and 2, wherefore a part of the film 3 which is not covered with the piezoelectric element 1, 2 is also covered with the resin layer 20.

The sound generator of this embodiment includes: the film 3; two piezoelectric elements 1 and 2 disposed on the upper and lower surfaces, respectively, of the film 3; and the resin layer 20 formed inside the frame members 5*a* and 5*b* so that the piezoelectric elements 1, 2 can be embedded therein, and accordingly, the multi-layer piezoelectric element 1 is capable of inducing flexural vibration of wavelengths corresponding to high-frequency sound, wherefore sound of superhigh-frequency components at levels of 100 KHz and above are reproducible.

Where peaks and dips entailed by a resonance phenomenon in the piezoelectric element 1, 2 are concerned, by embedding the piezoelectric elements 1 and 2 in the resin layer 20, it is possible to cause an adequate damping effect, with consequent suppression of a resonance phenomenon and minimization of peaks and dips, as well as to lessen the dependence of sound pressure on frequency.

Moreover, since a plurality of piezoelectric elements 1 and 2 attached to a single film 3 are subjected to the same voltage, it follows that vibrating motions generated by the piezoelectric elements 1 and 2 interfere with each other, thereby suppressing strong vibration, and, with the distribution of vibration, the effect of minimizing peaks and dips can be attained. Also in a superhigh-frequency range exceeding 100 KHz, a rise in sound pressure can be achieved.

The piezoelectric layer 7 can be made of, for example, lead zirconate (PZ), lead zirconate titanate (PZT), a non-lead piezoelectric material such as a Bi-layer compound and a compound with tungsten bronze-type structure, or other customarily-used piezoelectric ceramics. In light of low-voltage actuation, a single piezoelectric layer 7 should preferably have a thickness in a range of 10 to 100 μm.

It is preferable that the internal electrode layer 9 contains a metal component made of silver and palladium, and a material component used to form the piezoelectric layer 7. Where the internal electrode layer 9 contains a ceramic component which forms the piezoelectric layer 7, the stress resulting from the difference in thermal expansion between the piezoelectric layer 7 and the internal electrode layer 9 can be lessened, wherefore piezoelectric elements 1 and 2 free from any failure in layer lamination can be obtained. In the internal electrode layer 9, the metal component is not limited to that made of silver and palladium, and also, the material component is not limited to the ceramic component forming the piezoelectric layer 7, but may be of other different ceramic component.

It is preferable that the surface electrode layer 15*a*, 15*b* and the external electrode 17, 19 are made of a silver-made metal component having a glass content. The inclusion of a glass component makes it possible to provide high adherability between the surface electrode layer 15*a*, 15*b* or the external electrode 17, 19 and the piezoelectric layer 7, as well as the internal electrode layer 9.

Moreover, it is advisable to configure the piezoelectric element 1, 2 so that it has a polygonal, for example, square or rectangular contour as viewed in the stacking direction.

As shown in FIG. 1, the frame members 5*a* and 5*b* are each given a rectangular shape. The outer periphery of the film 3 is sandwiched between the frame members 5*a* and 5*b*, so that the film 3 can be secured under tension. For example, the frame member 5*a*, 5*b* may be made of stainless steel having a thickness in a range of 100 to 1000 μm. Note that the material of the frame member 5*a*, 5*b* is not limited to stainless steel, but may be another so long as it is less prone to deformation than is the resin layer 20, and therefore, for example, hard resin, plastic, engineering plastic, or ceramic can be used, and there is no particular limitation to the material, thickness, etc. of the frame member 5*a*, 5*b*. Also, the shape of the frame member 5*a*, 5*b* is not limited to a rectangle, but may be a circle or a rhombus.

The film 3 is, at its outer periphery, sandwiched between the frame members 5*a* and 5*b* so as to be secured by the frame members 5*a* and 5*b* under tension exerted in the planar direction of the film 3, and thus, the film 3 serves as a vibration plate. The thickness of the film 3 is adjusted to fall in a range of 10 to 200 μm, for example. The film 3 can be made of a resin such for example as polyethylene, polyimide, polypropylene, or polystyrene, or paper made of pulp, fiber, and so forth. The use of such a material makes it possible to minimize peaks and dips.

Next, a method for manufacturing a sound generator pursuant to the invention will be described.

First, the piezoelectric elements 1 and 2 are prepared. In forming the piezoelectric element 1, 2, a slurry is prepared by adding a binder, a dispersant, a plasticizer, and a solvent to powder of a piezoelectric material, with subsequent agitation. The piezoelectric material for use may either be a lead-based piezoelectric material or a non-lead piezoelectric material.

Next, the thusly obtained slurry is molded into sheets to form green sheets. A conductor paste is printed on the green sheet in internal-electrode patterns, and the green sheets provided with the internal-electrode patterns are laminated on top of each other, thereby forming a laminate molded product.

Next, the laminate molded product is subjected to degreasing and firing processes, and the fired laminate molded product is then cut into a predetermined dimension, whereby a stacked body 13 can be obtained. On an as needed basis, the stacked body 13 has its outer periphery machined. Subsequently, a conductor paste is printed on the main surfaces of the stacked body 13 in the stacking direction to form the surface electrode layers 15*a* and 15*b*, and also, a conductor paste is printed on each side surface of the stacked body 13 in the longitudinal direction thereof (the y-axis direction in the drawing) to form the external electrodes 17 and 19. Then, electrode baking process is performed at a predetermined temperature, whereby piezoelectric elements 1 and 2 as shown in FIGS. 1 and 2 can be obtained.

Next, in order to impart piezoelectric properties to the piezoelectric elements 1 and 2, a direct current voltage is applied thereto through the surface electrode layer 15*b* or the external electrode 17, 19 to effect polarization of the piezoelectric layers 7 of the piezoelectric element 1, 2. At this time, the direct current voltage is applied in a manner such that the piezoelectric layers are polarized in the directions indicated by arrows shown in FIG. 2.

Next, a film 3 which serves as a vibration plate is prepared, and the film 3 is, at its outer periphery, sandwiched between the frame members 5*a* and 5*b* so as to be secured under tension. More specifically, after an adhesive is applied to both sides of the film 3, the piezoelectric elements 1 and 2 are pressed against each side of the film 3 so that the film 3 is sandwiched between them, and, the adhesive is cured by heat application or ultraviolet irradiation. Then, a resin is charged inside the frame members 5*a* and 5*b* so that the piezoelectric elements 1 and 2 can be completely embedded in the resin, with subsequent resin curing process being performed, whereby the sound generator of the present embodiment can be obtained.

The thusly constructed sound generator of this embodiment is simple in structure, downsized, lower in profile, and is capable of maintaining high sound pressure in even up to a superhigh-frequency range. Moreover, the piezoelectric elements 1 and 2, being embedded in the resin layer 20, are impervious to water and so forth, which leads to enhanced reliability.

Moreover, the sound generator of this embodiment comprises at least the film 3 which serves as a vibration plate, and a plurality of spaced-apart piezoelectric elements attached to the film 3 for causing the film 3 to vibrate. In the plurality of piezoelectric elements, there are piezoelectric elements having at least two different thicknesses (piezoelectric elements 1 and 2). That is, the plurality of piezoelectric elements include piezoelectric elements having at least two different thicknesses (piezoelectric elements 1 and 2). The piezoelectric elements 1 and 2 having different thicknesses are disposed in respective two directions that cross each other in the main surface of the film 3 (two directions that are perpendicular to each other, namely the x-axis direction and the y-axis direction in the drawing). This makes it possible to minimize peaks and dips in sound-pressure frequency characteristics. This advantageous effect can be attained presumably on the grounds that, since the piezoelectric elements having different thicknesses differ from each other in respect of resonant frequency of bending vibration, by disposing the piezoelectric elements 1 and 2 having different thicknesses in the respective two directions that cross each other, it is possible to increase the number of produced vibrational modes, wherefore energy can be distributed among many vibrational modes, with consequent reduction of energy given to a single vibrational mode. It is preferable that the two directions that cross each other are directions perpendicular to the opposed sides of the frame member 5*a*, 5*b*, respectively. In this way, a lower degree of symmetry in the structure of the sound generator allows lowering of the level of peaks arising in sound-pressure frequency characteristics.

Moreover, in the sound generator of this embodiment, in each of two directions that cross each other in the main surface of the film 3 (the x-axis direction and the y-axis direction that are perpendicular to each other in the drawing), the adjacent piezoelectric elements 1 and 2 have different thicknesses. Accordingly, the sound-pressure frequency characteristics can be further improved. Presumably this effect is ascribable to uniformity in the distribution of vibration produced by the piezoelectric elements 1 and 2, as well as in the distribution of mass on the film 3, and also a lower degree of structural symmetry, for example.

Moreover, in the sound generator of this embodiment, in each of two directions that cross each other in the main surface of the film 3 (the x-axis direction and the y-axis direction that are perpendicular to each other in the drawing), piezoelectric elements having two different thicknesses (piezoelectric elements 1 and 2) are disposed to be alternating with each other. Accordingly, the sound-pressure frequency characteristics can be further improved. Presumably this effect is ascribable to uniformity in the distribution of vibration produced by the piezoelectric elements 1 and 2, as well as in the mass distribution on the film 3, and also a lower degree of structural symmetry, for example.

Moreover, in the sound generator of this embodiment, the numbers of the respective piezoelectric elements having the same thickness are equal. That is, the piezoelectric elements 1 and the piezoelectric elements 2 are equal in number. Accordingly, the sound-pressure frequency characteristics can be improved even further. Presumably this effect is ascribable to uniformity in the distribution of vibration produced by the piezoelectric elements 1 and 2, as well as in the mass distribution on the film 3, and also a lower degree of structural symmetry, for example.

Second Embodiment

Figure 3:
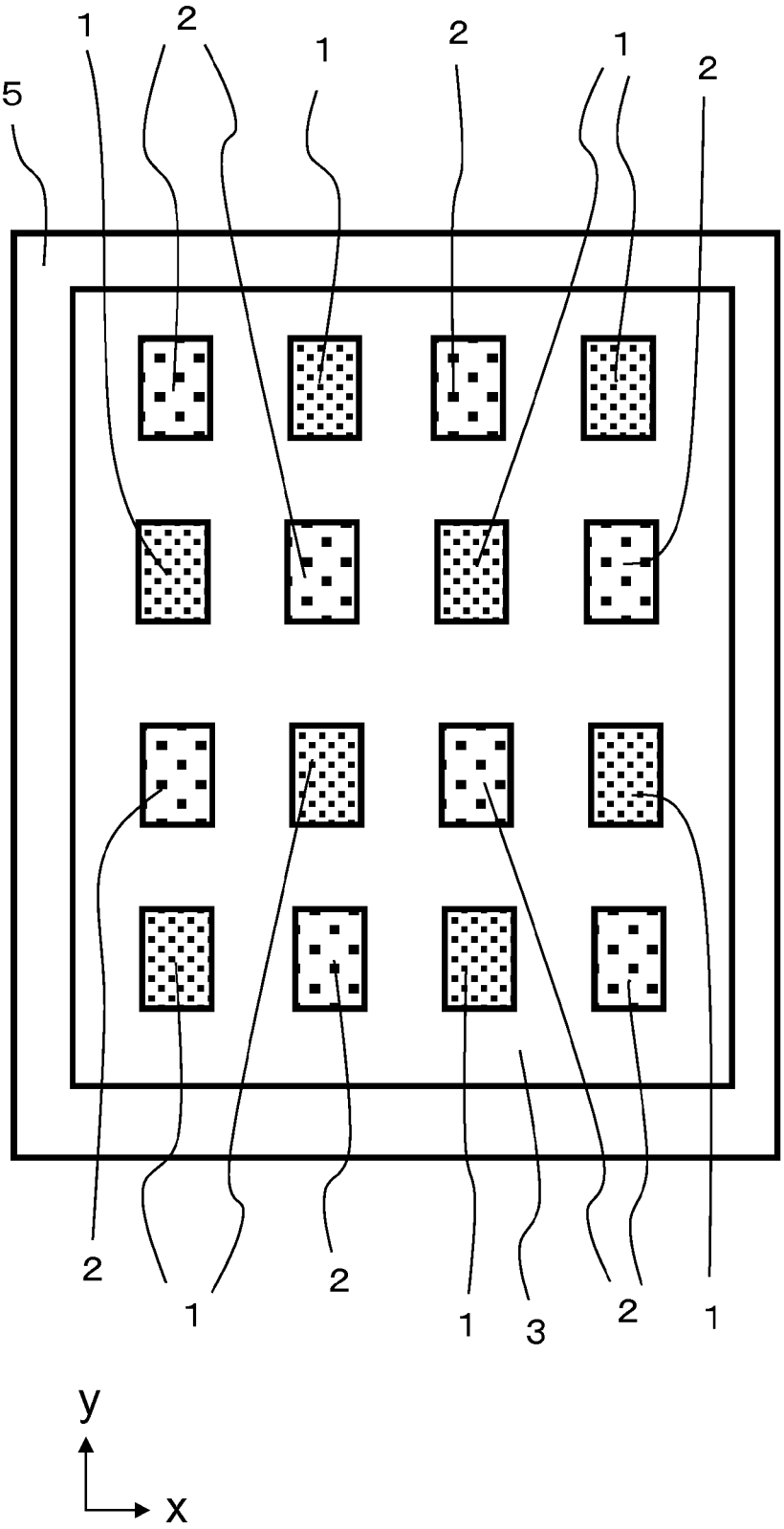
FIG. 3 is a plan view schematically showing a sound generator in accordance with a second embodiment of the invention.

FIG. 3 is a plan view schematically showing a sound generator in accordance with a second embodiment of the invention. For a better understanding of the structure, in FIG. 3, the diagrammatic illustration of the resin layer 20 and the conductor wires 22*a*, 22*b*, 22*c*, and 22*d* is omitted, and the diagrammatic illustration of detailed structure of the piezoelectric element 1, 2 is also omitted. Moreover, the following description of this embodiment will deal only with points of difference from the preceding first embodiment, and like constituent components will be identified with the same reference symbols and overlapping descriptions will be omitted.

In the sound generator of this embodiment, eight piezoelectric elements 1 and eight piezoelectric elements 2 are placed on each of the main surfaces of the film 3. That is, sixteen piezoelectric elements are placed on each main surface of the film 3, or equivalently the film 3 has a total of thirty-two piezoelectric elements in all. As is the case with the preceding first embodiment, the piezoelectric elements 1, 2 are disposed in pairs, and, two piezoelectric elements taken as a pair are placed in common positions on their respective main surfaces of the film 3 so as to hold the film 3 between them.

In the sound generator of this embodiment, in each of two directions that cross each other in the main surface of the film 3 (the x-axis direction and the y-axis direction that are perpendicular to each other in the drawing), piezoelectric elements having two different thicknesses (piezoelectric elements 1 and 2) are disposed to be alternating with each other. Accordingly, the sound-pressure frequency characteristics can be improved. Presumably this effect is ascribable to uniformity in the distribution of vibration produced by the piezoelectric elements 1 and 2, as well as in the mass distribution on the film 3, and also a lower degree of structural symmetry, for example.

Moreover, in the sound generator of this embodiment, since a larger number of piezoelectric elements 1, 2 are placed on the film 3 than in the sound generator of the preceding first embodiment, it is possible to achieve further lowering of the level of peaks and dips in sound-pressure frequency characteristics. Presumably this effect is ascribable to a further increase in the number of vibrational modes that occur on the film 3.

Moreover, in the sound generator of this embodiment, in each of two directions that cross each other in the main surface of the film 3 (the x-axis direction and the y-axis direction that are perpendicular to each other in the drawing), the piezoelectric elements having different thicknesses (piezoelectric elements 1 and 2) are equi-spaced. Accordingly, the sound-pressure frequency characteristics can be further improved. Presumably this effect is ascribable to uniformity in the distribution of vibration produced by the piezoelectric elements 1 and 2, as well as in the mass distribution on the film 3, and also a lower degree of structural symmetry, for example.

Moreover, in the sound generator of this embodiment, in each of two directions that cross each other in the main surface of the film 3 (the x-axis direction and the y-axis direction that are perpendicular to each other in the drawing), intervals among piezoelectric elements having different thicknesses (piezoelectric elements 1 and 2) are equal. That is, the interval between the piezoelectric elements 1 and the interval between the piezoelectric elements 2 are equal.

Accordingly, the sound-pressure frequency characteristics can be improved even further. Presumably this effect is ascribable to uniformity in the distribution of vibration produced by the piezoelectric elements 1 and 2, as well as in the mass distribution on the film 3, and also a lower degree of structural symmetry, for example.

Third Embodiment

Figure 4:
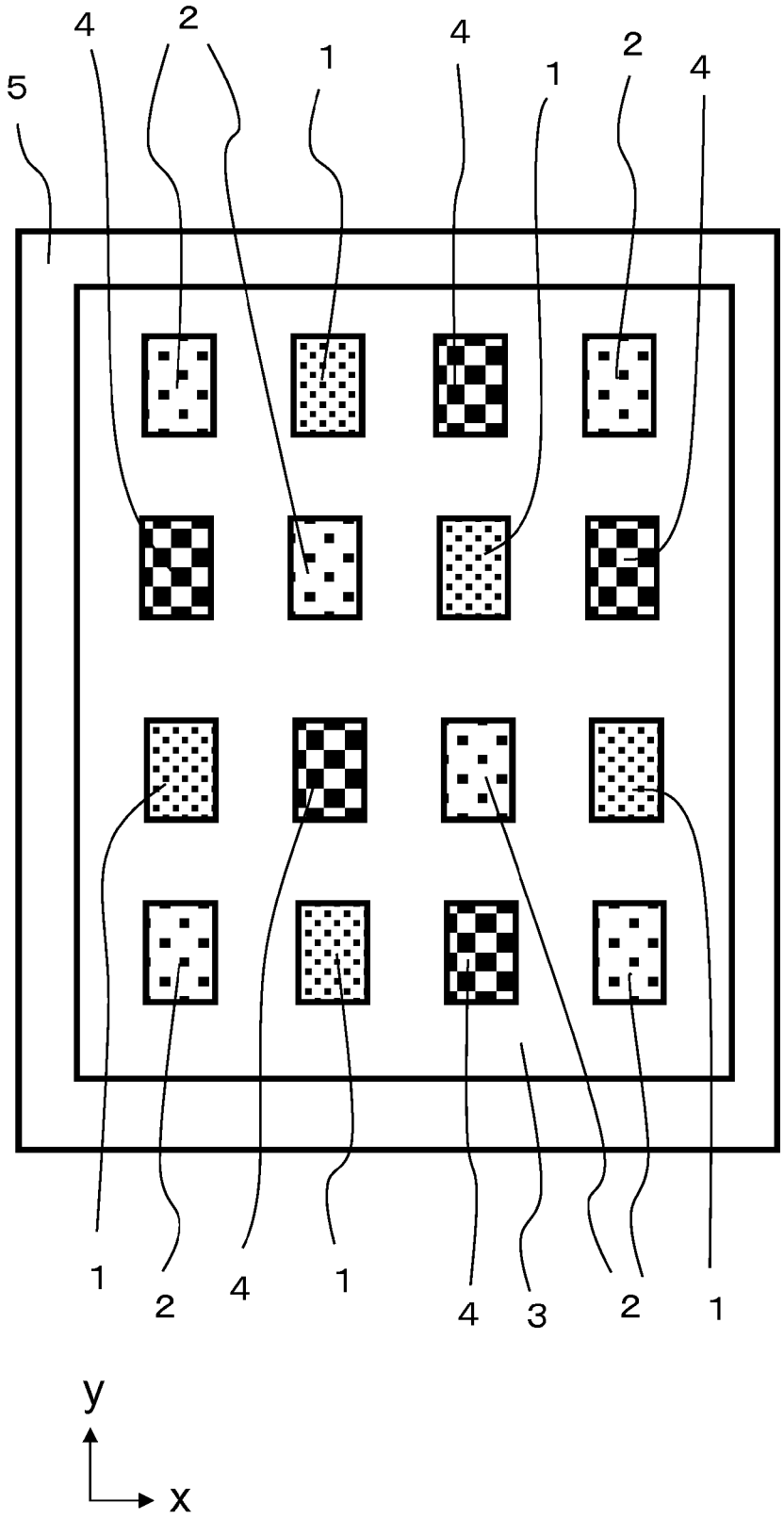
FIG. 4 is a plan view schematically showing a sound generator in accordance with a third embodiment of the invention.

FIG. 4 is a plan view schematically showing a sound generator in accordance with a third embodiment of the invention. For a better understanding of the structure, in FIG. 4, the diagrammatic illustration of the resin layer 20 and the conductor wires 22*a*, 22*b*, 22*c*, and 22*d* is omitted, and the diagrammatic illustration of detailed structure of the piezoelectric element 1, 2, 4 is also omitted. Moreover, the following description of this embodiment will deal only with points of difference from the preceding second embodiment, and like constituent components will be identified with the same reference symbols and overlapping descriptions will be omitted.

In the sound generator of this embodiment, five piezoelectric elements 1, six piezoelectric elements 2, and five piezoelectric elements 4 are placed on each of the main surfaces of the film 3. That is, sixteen piezoelectric elements are placed on each main surface of the film 3, or equivalently the film 3 has a total of thirty-two piezoelectric elements in all. The piezoelectric element 4, while having substantially the same configuration as that of the piezoelectric element 1, 2, includes six piezoelectric layers 7 and five internal electrode layers 9, and has a thickness about three times larger than that of the piezoelectric element 2.

In the sound generator of this embodiment, in respective two directions that cross each other in the main surface of the film 33 (two directions that are perpendicular to each other, namely x-axis direction and y-axis direction as indicated in the drawing), the piezoelectric elements having different thicknesses (piezoelectric elements 1, 2, and 4) are disposed in sequence. Accordingly, the sound-pressure frequency characteristics can be improved. Presumably this effect is ascribable to uniformity in the distribution of vibration produced by the piezoelectric elements 1 and 2, as well as in the mass distribution on the film 3, and also a lower degree of structural symmetry, for example.

Fourth Embodiment

Figure 5:
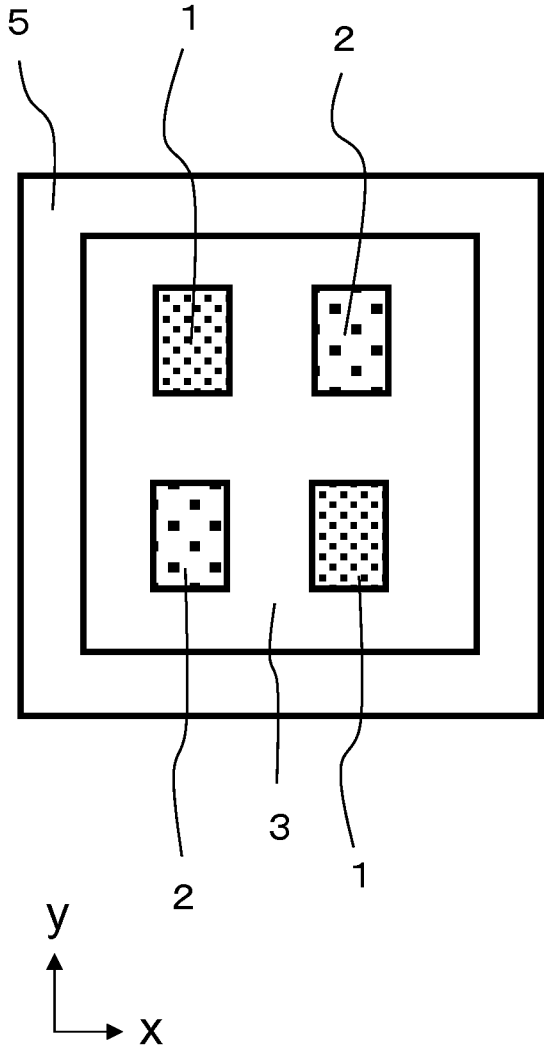
FIG. 5 is a plan view schematically showing a sound generator in accordance with a fourth embodiment of the invention.

FIG. 5 is a plan view schematically showing a sound generator in accordance with a fourth embodiment of the invention. For a better understanding of the structure, in FIG. 5, the diagrammatic illustration of the resin layer 20 and the conductor wires 22*a*, 22*b*, 22*c*, and 22*d* is omitted, and the diagrammatic illustration of detailed structure of the piezoelectric element 1, 2 is also omitted. Moreover, the following description of this embodiment will deal only with points of difference from the preceding second embodiment, and like constituent components will be identified with the same reference symbols and overlapping descriptions will be omitted.

In the sound generator of this embodiment, two piezoelectric elements 1 and two piezoelectric elements 2 are placed on one of the main surfaces of the film 3 (one main surface where the frame member 5*a* is situated). That is, four piezoelectric elements are placed on one main surface (where the frame member 5*a* is situated) of the film 3, but there is no piezoelectric element on the other of the main surfaces of the film 3 (the other main surface where the frame member 5*b* is situated). Also, the resin layer 20 is placed only on one main surface of the film 3, viz., not placed on the other main surface of the film 3. Moreover, the piezoelectric elements 1 and 2 provided in the sound generator of this embodiment are each a bimorph-type piezoelectric element. That is, the piezoelectric element 1, 2 of the sound generator of this embodiment, being designed so that one side and the other side thereof in the thickness-wise direction (the z-axis direction perpendicular to each of the x-axis direction and the y-axis direction in the drawing) are reversed in respect of the relationship between polarization direction and electric-field direction at a certain moment in time, is able to vibrate flexurally by itself in response to input of an electric signal.

Also in the sound generator of this embodiment, since piezoelectric elements having two different thicknesses (piezoelectric elements 1 and 2) are disposed in respective two directions that cross each other in the main surface of the film 3 (the x-axis direction and the y-axis direction that are perpendicular to each other in the drawing), it is possible to lower the level of peaks arising in sound-pressure frequency characteristics. Moreover, since the piezoelectric elements 1 and 2 having different thicknesses are disposed to be alternating with each other in the respective two directions that cross each other in the main surface of the film 3 (the x-axis direction and the y-axis direction that are perpendicular to each other in the drawing), it is possible to lower the level of peaks arising in sound-pressure frequency characteristics even further.

Fifth Embodiment

Figure 6:
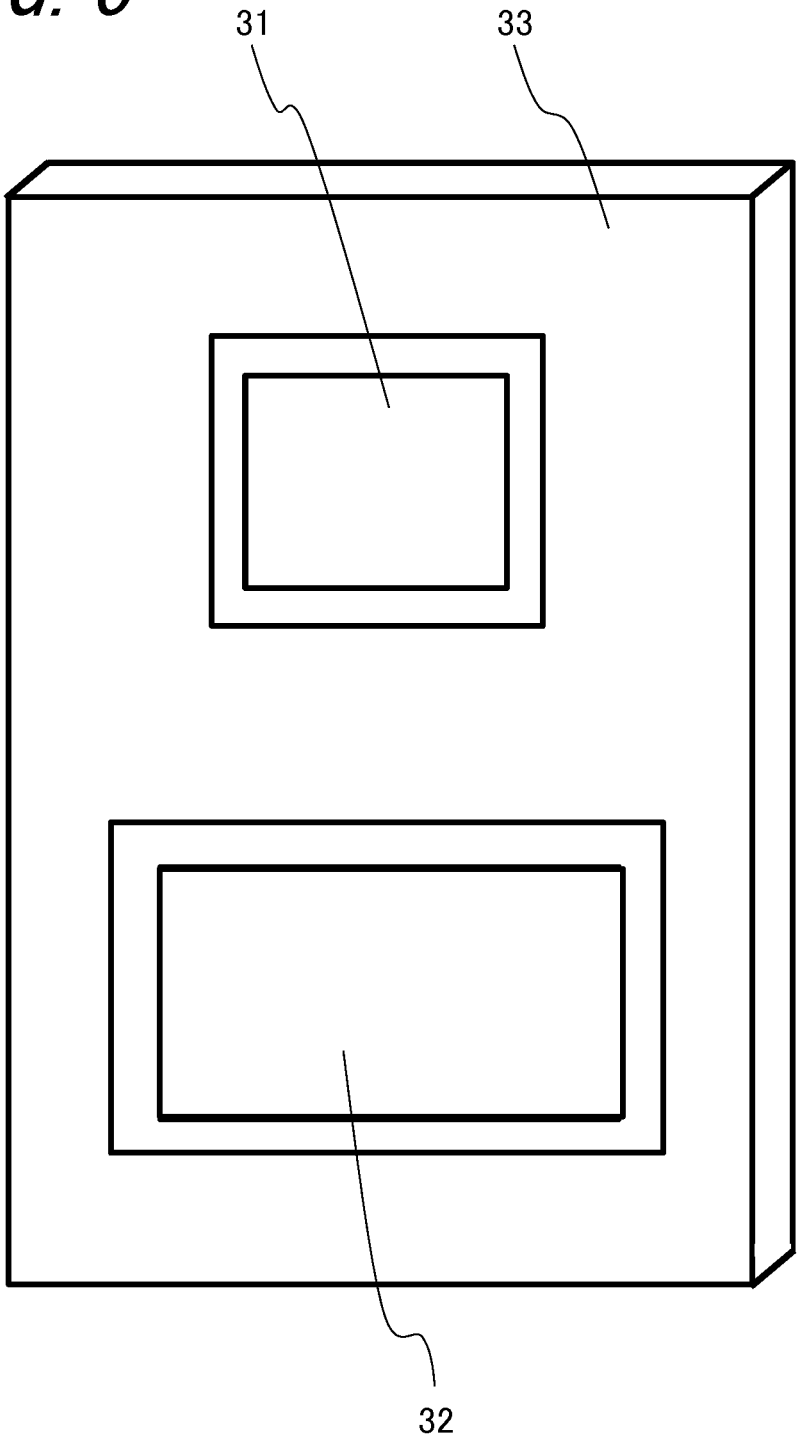
FIG. 6 is a perspective view schematically showing a sound-generating apparatus in accordance with a fifth embodiment of the invention.

FIG. 6 is a perspective view schematically showing a sound-generating apparatus in accordance with a fifth embodiment of the invention. As shown in FIG. 6, the sound-generating apparatus of this embodiment comprises: a high-pitched sound speaker 31; a low-pitched sound speaker 32; and a support body 33.

The high-pitched sound speaker 31, which is the sound generator of the first embodiment, is a speaker for outputting high-pitched sound mainly. For example, it is used to output sound with frequencies of about 20 KHz or above.

The low-pitched sound speaker 32 is a speaker for outputting low-pitched sound mainly. For example, it is used to output sound with frequencies of about 20 KHz or below. The low-pitched sound speaker 32 may be of a type which has, for example, the form of a rectangle or an ellipse, whose long side or major axis is longer than that of the high-pitched sound speaker 31 from the viewpoint of facilitating low-frequency sound output, and is otherwise similar in configuration to the high-pitched sound speaker 31.

The support body 33 is made of, for example, a metallic plate, and is formed with two openings for fixedly receiving the high-pitched sound speaker 31 and the low-pitched sound speaker 32, respectively.

The thusly constructed sound-generating apparatus of this embodiment utilizes the sound generator of the first embodiment as the high-pitched sound speaker 31, and is therefore capable of outputting high-pitched sound with less peaks and dips in sound-pressure frequency characteristics.

As above described, the sound-generating apparatus of this embodiment comprises at least: at least one high-pitched sound speaker 31; at least one low-pitched sound speaker 32; and the support body 33 for supporting the high-pitched sound speaker 31 and the low-pitched sound speaker 32, and, at least one of the high-pitched sound speaker 31 and the low-pitched sound speaker 32 is constructed of the earlier described sound generator of the invention. Accordingly, there is obtained a high-performance sound-generating apparatus capable of outputting sound with less peaks and dips in sound-pressure frequency characteristics.

Modified Example

It should be understood that the application of the invention is not limited to the embodiments described heretofore, and that various modifications and improvements are possible without departing from the scope of the invention.

For example, the number of the piezoelectric elements attached to the film 3 is not limited to those as specified in the earlier described embodiments. Moreover, it is possible to provide vibrators having four or more different thicknesses.

Moreover, although the first embodiment has been described with respect to the case where the film 3 is utilized as a vibration plate, this does not constitute any limitation. For example, a plate made of metal or resin may be utilized as a vibration plate.

In addition, although the foregoing embodiments have been described with respect to the case where the resin layer 20 is formed to cover the surfaces of the film 3 and the piezoelectric elements, this does not constitute any limitation. The resin layer 20 does not necessarily have to be provided.

EXAMPLES

First Example

A concrete example of the sound generator of the invention will be described. A sound generator in accordance with the first embodiment of the invention as shown in FIGS. 1 and 2 was produced, and electrical characteristics measurement was performed thereon.

To begin with, a slurry was prepared by kneading piezoelectric powder containing lead zirconate titanate (PZT) in which Sb was substituted in part for Zr, a binder, a dispersant, a plasticizer, and a solvent for 24 hours by means of ball mill mixing. The thusly prepared slurry was been shaped into green sheets by doctor blade technique. As the material of electrodes, a conductor paste containing Ag and Pd was applied, in predetermined form, to the green sheets by screen printing. Then, green sheets with the printed conductor paste and green sheets with no printed conductor paste were stacked on top of each other under pressure to form a laminate molded product. The laminate molded product was subjected to degreasing process in the atmosphere at 500° C. for 1 hour, and whereafter fired in the atmosphere at 1100° C. for 3 hours, whereby a stacked body was obtained.

Subsequently, the thusly obtained stacked body had its end faces in the longitudinal direction (the y-axis direction in the drawing) cut by dicing, so that the tips of the internal electrode layers 9 could be exposed at the side of the stacked body. Then, in order to form the surface electrode layer 15*a*, 15*b* on each main surface of the stacked body, a conductor paste containing Ag and glass was applied to one of the main surfaces of the piezoelectric by screen printing. After that, as the material of the external electrodes 17 and 19, a conductor paste containing Ag and glass was applied to each side surface of the stacked body in the longitudinal direction (the y-axis direction in the drawing) by dipping, and a baking finish was performed in the atmosphere at 700° C. for 10 minutes. In this way, stacked bodies 13 as shown in FIG. 2 were produced. In the thusly produced stacked body, dimensions of the main surface were 6 mm in width and 7 mm in length. The thickness of the stacked body 13 used for the piezoelectric element 1 was 100 μm, whereas the thickness of the stacked body 13 used for the piezoelectric element 2 was 50 μm.

Next, a voltage of 100 V was applied between the internal electrode layers 9, as well as between the internal electrode layer 9 and the surface electrode layer 15*a*, 15*b*, for 2 minutes through the external electrodes 17 and 19 to effect polarization, whereby a unimorph-type multi-layer piezoelectric element was obtained.

Next, a 25 μm-thick film 3 made of polyimide resin was prepared, and this film 3 was secured to the frame members 5*a* and 5*b* under tension. Then, an acrylic resin-made adhesive was applied to each main surface of the fixed film 3, and the piezoelectric element 1, 2 was pressed against part of the adhesive-coated film 3 so that the film 3 was sandwiched on both sides by the piezoelectric elements, and subsequently the adhesive was cured in the atmosphere at 120° C. for 1 hour, whereby a 5 μm-thick adhesive layer 21 was formed. The film 3 lying inside the frame members 5*a* and 5*b* was 48 mm in length and 18 mm in width. The interval between the piezoelectric elements 1, 2 disposed adjacent to each other in the lengthwise direction of the sound generator (the x-axis direction in the drawing) was set at 6 mm, whereas the interval between the piezoelectric elements disposed adjacent to each other in the widthwise direction of the sound generator (the y-axis direction in the drawing) was set at 1 mm. After that, conductor wires 2*a*, 2*b*, 2*c*, and 2*d* were joined to the piezoelectric elements 1 and 2 for wiring installation.

Moreover, an acrylic resin which exhibited a Young's modulus of 17 MPa in a cured state was poured inside the frame members 5*a* and 5*b* so as to be flush with the frame members 5*a* and 5*b*, with subsequent curing process, whereby a resin layer 20 was formed. In this way, a sound generator as shown in FIGS. 1 and 2 was produced.

Figure 7:
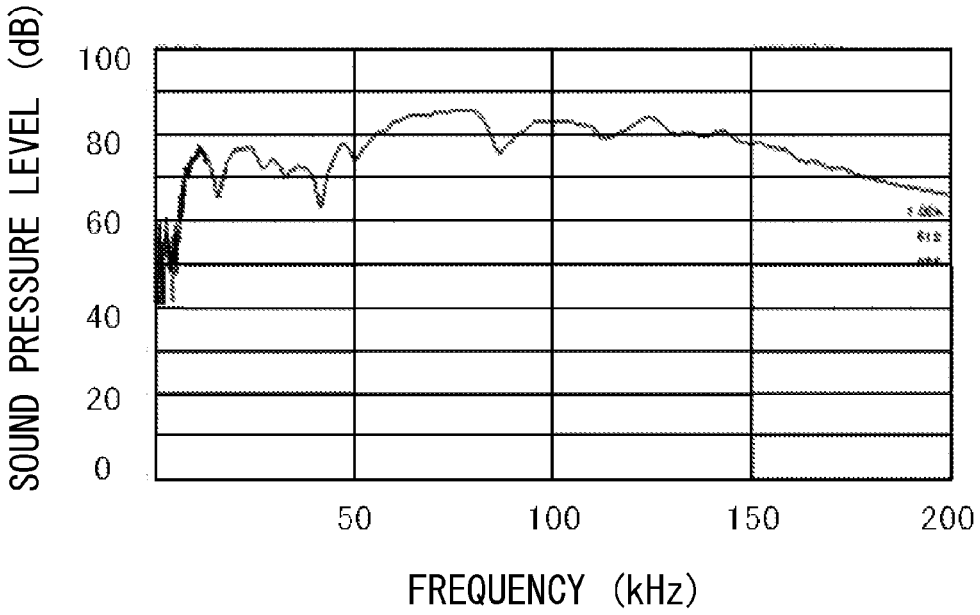
FIG. 7 is a graph indicating sound-pressure frequency characteristics of the sound generator in accordance with the first embodiment of the invention.
Figure 8:
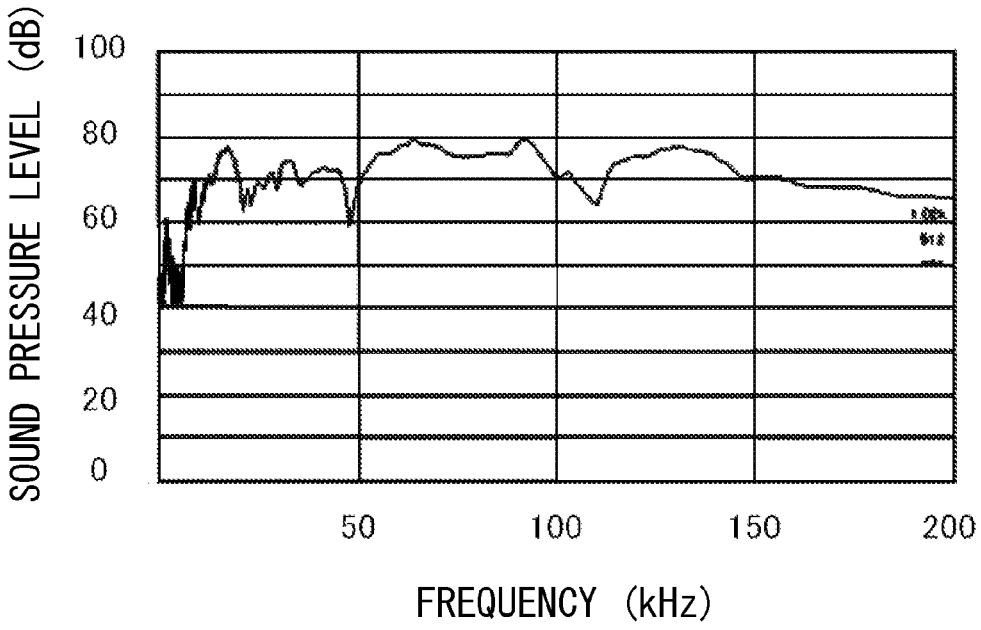
FIG. 8 is a graph indicating sound-pressure frequency characteristics of a sound generator implemented as a first comparative example.

Evaluation of sound-pressure frequency characteristics was conducted on the thereby produced sound generator in conformity with JEITA (Japan Electronics and Information Technology Industries Association) Standard EIJA RC-8124A. More specifically, for sound pressure evaluation, a sinusoidal signal of 2.8 V (RMS) was inputted between the conductor wires 22*b* and 22*c* of the sound generator, and a microphone was set at a point on the reference axis of the sound generator at a distance of 1 m. The result of the evaluation is shown in FIG. 7. Moreover, as a first comparative example, a sound generator in which the piezoelectric elements 1 and 2 all had the same thickness was fabricated, and this sound generator was also subjected to evaluation of sound-pressure frequency characteristics. The result of the evaluation on the sound generator of the first comparative example is shown in FIG. 8. In the graphs shown in FIGS. 7 and 8, the abscissa axis represents frequency, and the ordinate axis represents sound pressure.

According to the graph shown in FIG. 7, it has been found out that high sound pressure exceeding 70 dB can be obtained at most of frequencies within a wide frequency wave range of about 20 to 180 kHz. Moreover, it has been found out that, in contrast to the sound-pressure frequency characteristics of the sound generator of the first comparative example shown in FIG. 8, peaks and dips were minimized, with consequent attainment of substantially flat, excellent sound-pressure characteristics. Thus, the invention has proven itself in respect of its effectiveness.

Second Example

Figure 9:
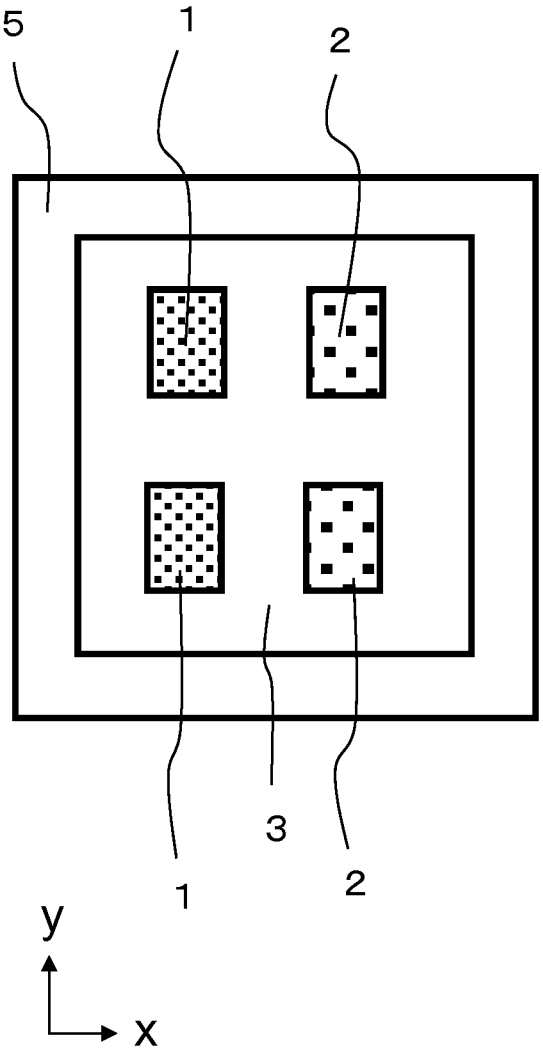
FIG. 9 is a plan view schematically showing a sound generator implemented as a second comparative example.

In each of the sound generator of the fourth embodiment shown in FIG. 5 and a sound generator implemented as a second comparative example as shown in FIG. 9, the eigenvalue of vibration which exerted an influence upon sound-pressure characteristics (the number of vibrational modes)

was determined by calculation through simulations. Note that the sound generator of the fourth embodiment shown in FIG. 5 and the sound generator of the second comparative example shown in FIG. 9 differ from each other only in terms of the way of placement of the piezoelectric elements 1 and 2. That is, in the sound generator of the fourth embodiment shown in FIG. 5, piezoelectric elements having two different thicknesses (piezoelectric elements 1 and 2) are disposed in respective two directions that cross each other (the x-axis direction and the y-axis direction that are perpendicular to each other in the drawing). On the other hand, in the sound generator of the second comparative example shown in FIG. 9, although piezoelectric elements having two different thicknesses (piezoelectric elements 1 and 2) are disposed in the x-axis direction indicated in the drawing, piezoelectric elements having the same thickness alone are disposed in the y-axis direction indicated in the drawing. That is, the sound generator of the second comparative example shown in FIG. 9 has a line-symmetric configuration, and more specifically is symmetrical about a line located centrally thereof in the y-axis direction in the drawing while extending in parallel with the x-axis direction.

In this simulation, the frame member 5*a*, 5*b* was defined by a frame shape which was 60 mm in outer length, 50 mm in outer width, 50 mm in inner length, 40 mm in inner width, and 1 mm in thickness. The thickness of the film 3 was 0.03 mm. The piezoelectric element 1 was defined by a square plate shape which was 10 mm on a side and 0.1 mm in thickness. The piezoelectric element 2 was defined by a square plate shape which was 10 mm on a side and 0.05 mm in thickness. An interval of 15 mm was secured between adjacent piezoelectric elements.

According to the result of the simulation, the number of the eigenvalues of vibration exerting an influence upon sound-pressure characteristics in a frequency range of 1 kHz to 10 kHz found in the sound generator of the second comparative example shown in FIG. 9 was 38, whereas the same found in the sound generator of the fourth embodiment shown in FIG. 5 was 73. That is, it has been found out that the number of vibrational modes occurring in the sound generator of the fourth embodiment shown in FIG. 5 is about twice the number of vibrational modes occurring in the sound generator of the second comparative example shown in FIG. 9. This is one evidence that supports the theory that, in the sound generator of the invention, the number of produced vibrational modes is increased for distribution of peaks arising in sound-pressure frequency characteristics, and this makes it possible to lower the level of peaks arising in sound-pressure frequency characteristics and thereby attain even flatter sound-pressure characteristics.

REFERENCE SIGNS LIST

1, 2, 4: Piezoelectric element
3: Film
31: High-pitched sound speaker
32: Low-pitched sound speaker
33: Support body

The invention claimed is:

1. A sound generator, comprising:
a vibration plate;
a frame member to which a periphery of the vibration plate is secured;
a plurality of piezoelectric elements attached to the vibration plate so as to be spaced from each other to cause the vibration plate to vibrate; and
a resin layer disposed inside the frame member,
the plurality of piezoelectric elements including piezoelectric elements having at least two different thicknesses, the plurality of piezoelectric elements having at least two different thicknesses being disposed in two directions that cross each other in a main surface of the vibration plate, the plurality of piezoelectric elements being spaced from the frame member,
the resin layer having a thickness larger than thicknesses of the plurality of piezoelectric elements having at least two different thicknesses and being arranged so as to cover all the plurality of piezoelectric elements.

2. The sound generator according to claim 1, wherein piezoelectric elements disposed adjacent to each other in the respective two directions have different thicknesses.

3. The sound generator according to claim 2, wherein piezoelectric elements having different thicknesses are disposed in sequence in the respective two directions.

4. The sound generator according to claim 3, wherein piezoelectric elements having two different thicknesses are disposed to be alternating with each other in the respective two directions.

5. The sound generator according to claim 1, wherein respective piezoelectric elements having a same thickness in the respective two directions are disposed at equally-spaced intervals from a subsequent piezoelectric element having a different thickness.

6. The sound generator according to claim 5, wherein the respective piezoelectric elements having the same thickness are disposed at equally-spaced intervals from each other in the respective two directions.

7. The sound generator according to claim 1, wherein numbers of respective piezoelectric elements having a same thickness are equal.

8. A sound-generating apparatus, comprising:
at least one high-pitched sound speaker;
at least one low-pitched sound speaker; and
a support body which supports the high-pitched sound speaker and the low-pitched sound speaker,
at least one of the high-pitched sound speaker and the low-pitched sound speaker being constructed of the sound generator according to claim 1.

9. The sound generator according to claim 1, wherein the resin layer vibrates unitarily with the vibration plate to generate sound.

10. A sound-generating apparatus, comprising:
one or more sound speakers; and
a support body which supports the one or more sound speakers,
wherein at least one of the one or more sound speakers is the sound generator according to claim 1.

* * * * *